US005375779A

United States Patent [19]

Ephraim

[11] Patent Number: 5,375,779

[45] Date of Patent: Dec. 27, 1994

[54] PROCESS FOR GRINDING LIMESTONE TO PREDETERMINED PARTICLE SIZE DISTRIBUTION

[75] Inventor: Daniel R. Ephraim, Glencoe, Ill.

[73] Assignee: Modern Process Equipment, Inc., Chicago, Ill.

[21] Appl. No.: 170,150

[22] Filed: Dec. 20, 1993

[51] Int. Cl.[5] ..... B02C 23/08

[52] U.S. Cl. ..... 241/24; 241/29

[58] Field of Search ..... 241/24, 29, 158, 159

[56] References Cited

U.S. PATENT DOCUMENTS

| | | | |
|---|---|---|---|
| 2,549,501 | 4/1951 | McClelland | 74/242.11 |
| 2,655,815 | 10/1953 | McClelland | 74/242.11 |
| 2,925,226 | 2/1960 | Pratique | 241/225 |
| 2,986,348 | 5/1961 | Noll et al. | 241/222 |
| 3,622,083 | 11/1971 | Greenwald, Jr. | 241/3 |
| 3,933,086 | 1/1976 | Standing | 99/646 R |
| 4,377,260 | 3/1983 | Huffman | 241/101.2 |
| 4,703,897 | 11/1987 | Beisner et al. | 241/29 X |
| 4,840,315 | 6/1989 | Rubin et al. | 241/29 X |
| 5,048,763 | 9/1991 | Szazdi, Jr. et al. | 241/24 |
| 5,114,131 | 5/1992 | Strasser et al. | 241/29 X |
| 5,203,512 | 4/1993 | Ferraris et al. | 241/16 |

FOREIGN PATENT DOCUMENTS

| | | | |
|---|---|---|---|
| 482748 | 9/1929 | Germany | 241/29 |

OTHER PUBLICATIONS

Book, Proceedings of SO2 Capture Seminar "Sorbent Options and Considerations", at Cincinnati, Ohio, National Stone Association, Cosponsors: National Lime Association Ohio River Valley Consortium.

Reprint, "Lime/Limestone Reagent Selection Process", by William S. Delis & Daniel E. Depperman, 6 pages.

Reprint "Effects of Limestone Quality on Wet Limestone FGD Design and Performance", by Chung L. Yeh, Pure Air, Allentown, Pennsylvania.

Reprint, "Flue Gas Desulfurization System Design Using Magnesium Enhanced Lime", by Robert W. Telesz Marketing Manager FGD Systems, Babcock & Wilcox.

Reprint, "Limestone in Fgd Final Sizing By The Utility", Hoosier Energy R.E.C., Inc. Merom Generating Station by Jeff Jernberg for National Stone Association.

*Primary Examiner*—Timothy V. Eley

*Attorney, Agent, or Firm*—Dressler, Goldsmith, Shore & Milnamow, Ltd.

[57] ABSTRACT

A novel process for grinding limestone to a predetermined particle size distribution is disclosed. The process comprises feeding a feedstock of limestone to a roll grinder having a pair of opposing rotating rolls having a smooth surface, the rolls being separated by a predetermined nip or gap and having a predetermined circumferential velocity, and grinding the limestone between the rolls to a particle size distribution including particles in a range of about 75% to about 90% by weight greater than 200 mesh to produce a limestone product. Optionally, particles larger than about 14 to 16 mesh are removed, in a separator, and refed to the roll grinder.

6 Claims, 2 Drawing Sheets

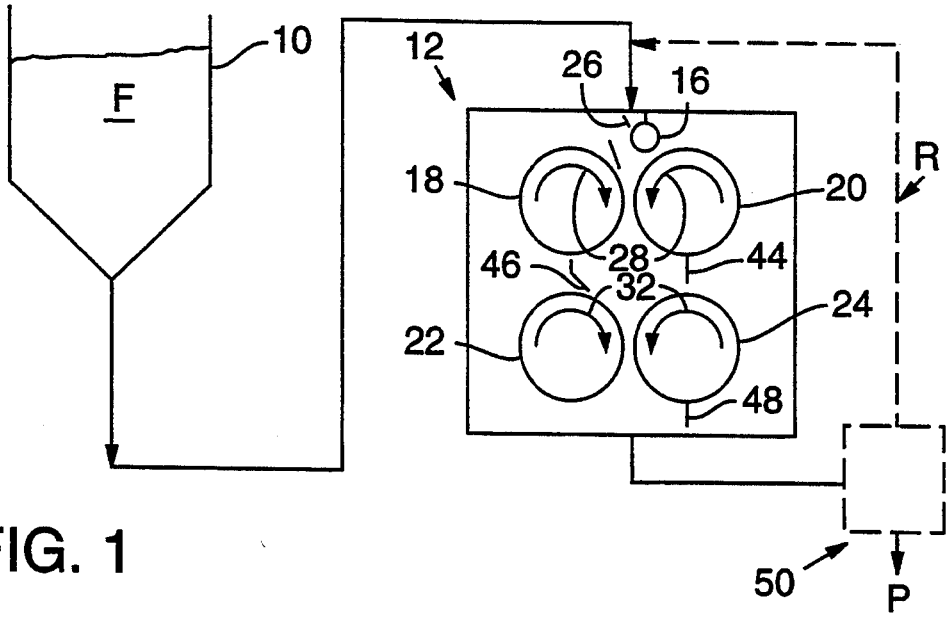
FIG. 1
FIG. 2
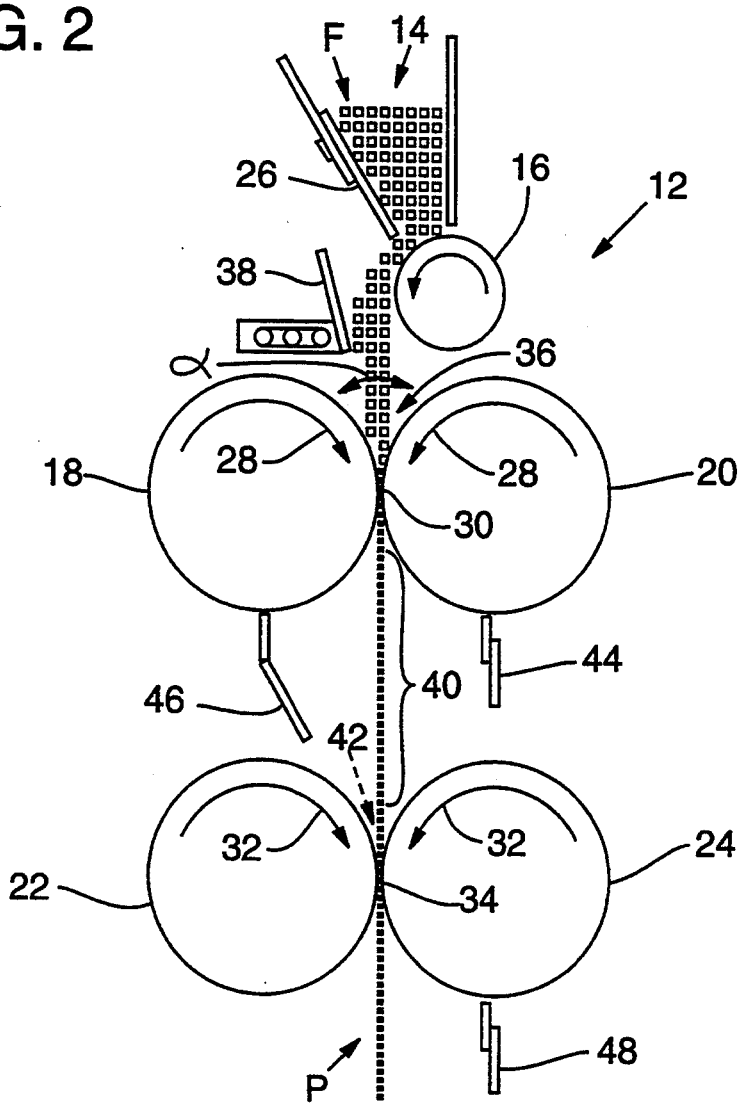

PROCESS FOR GRINDING LIMESTONE TO PREDETERMINED PARTICLE SIZE DISTRIBUTION

FIELD OF THE INVENTION

This invention relates to a process for grinding limestone to a predetermined particle size distribution and more particularly to a process for grinding limestone to a predetermined particle size distribution in a roll grinder having smooth-surfaced rolls separated by a predetermined nip or gap.

BACKGROUND OF THE INVENTION

Limestone is a natural crystalline mineral, which has as its major constituent calcium carbonate, characterized chemically as $CaCO_3$. Limestone is used in many processes including chemical manufacturing, agricultural product manufacturing, and construction material manufacturing. In particular, limestone is used in power plant boilers for flue gas desulfurization or flue gas scrubbing, which is a process for removing sulfur-based compounds such as sulfur dioxide ($SO_2$) from flue gas prior to discharge to the atmosphere. In the most basic exemplification of a flue gas desulfurization process, limestone is mixed with a liquid carrier such as water to create a slurry. The slurry is then transported to a scrubbing tower where it is injected into and intimately mixed with the flue gas stream which is discharged from the boiler. The intimate mixing of the limestone and flue gas at elevated temperatures fosters the desulfurization or scrubbing process.

Limestone is also used as a desulfurizing or scrubbing medium in fluidized bed combustion units. In these units, combustion materials such as coal and the like are fluidized and combusted in a combustion vessel by contact with upflowing high temperature gasses. In modern practice, limestone is mixed with the combustion materials prior to feeding of the mixture into the vessel, and the desulfurization process is effectuated in the vessel during combustion.

The scrubbing or desulfurization process is a chemical reaction. Therefore, the proper stoichiometric ratio of limestone containing calcium carbonate to flue gas will produce the most efficient reaction. In order for the desulfurization reaction to proceed efficiently and with minimal waste, the limestone must be processed such as by grinding to produce a defined particle size prior to use. In the fluidized bed combustion process, it is of utmost importance to control limestone particle size distribution to within stringent standards. If the particles are too large, the desulfurization process will not be efficient because there is insufficient limestone particle surface area to react with the flue gas. On the other hand, if the particles are small fines of limestone dust particles, generally smaller than 200 mesh, the limestone will be carried out of the vessel with the flue gas before it can react to remove the sulfur.

Hammer mills, vertical roll crushers, and other types of mills are typically used to grind limestone. However, the present grinding processes often produce a high quantity of fines, and further lack the ability to control the particle size distribution. Often, the quantity of fines which is produced in such grinding processes far exceeds that which is acceptable for certain uses such as desulfurization in the fluidized bed combustion process.

Roll grinders are not presently used in grinding processes for limestone, but, such grinders are used in grinding processes for milled products such as flour and the like. The grinders used in these processes typically comprise opposing rotating corrugated rolls which may rotate at different velocities relative to each other to produce a shearing force across the grinding surfaces of the rolls. This shear is imparted to the milled substance to produce a grinding effect. The grinding action occurs due to the hammer and anvil type crushing effect of the projections of one roll meshing with the corrugations of the other roll.

If used to grind limestone, the corrugated rolls would have a number of disadvantages. First, corrugated rolls would tend to "blind", that is the limestone would stick to the rolls and fill the corrugations. Consequently, the hammer and anvil type crushing effect of the rolls would be lost. Second, the projections on the corrugated rolls would tend to wear rapidly due to the abrasive action of the limestone against the rollers. This would reduce the effectiveness of the rolls and would tend to decrease the control over the final product particle size distribution. Thus, the nature of the limestone precludes the use of corrugated roll grinders.

SUMMARY OF THE INVENTION

A novel process for grinding limestone to a predetermined particle size distribution is disclosed. The process comprises the steps of providing a limestone feedstock, feeding the feedstock in at least one pass into a roll grinder having a first pair of opposing rotating rolls having smooth surfaces, the rolls being separated by a predetermined nip therebetween and having a predetermined circumferential velocity, and grinding the limestone feedstock between the rolls to a particle size distribution including particles in a range of about 75% to about 90% by weight greater than 200 mesh to produce a limestone product.

In a preferred process, the limestone is fed through a second pair of opposing rotating rolls having smooth surfaces, the second pair of rolls being separated by a second predetermined nip, the second predetermined nip being less than the first nip, the second pair of rolls having a predetermined circumferential velocity.

It is to be understood that in the present process, at least one of the first and second pairs of rolls may rotate at a differential velocity, the differential velocity being in the range of about 1:1 to about 2:1.

In a preferred process the particle size distribution is about 90% by weight greater than 200 mesh, about 80% by weight greater than 100 mesh, about 68% by weight greater than 60 mesh, and about 1% by weight greater than 16 mesh.

In the preferred process, the first pair of rolls are separated by a nip of about 0.05 inch to about 0.3 inch, and the second pair of rolls are separated by a nip of about 0.01 inch to about 0.05 inch.

The present process also contemplates the use of roll grinders having more than two pairs of opposing rotating rolls having smooth surfaces.

The present process further contemplates the step of separating the limestone product to remove the particles which are larger than the desired product size distribution and refeeding the removed particles back into the grinder.

Herein, all references to mesh numbers are intended to refer to Standard U.S. Series screen sizes, as provided in Perry and Chilton, *Chemical Engineers' Handbook*, §21 (5th ed. 1973).

These and other objects, features, and advantages of this invention are evident from the following description of the preferred embodiment of this invention with reference to the accompanying drawings.

BRIEF DESCRIPTION OF THE DRAWINGS

FIG. 1 is a simplified, schematic illustration of the process flow diagram of the present invention.

FIG. 2 is a cross-sectional, elevational view of an exemplary apparatus for carrying out the process of the present invention.

DETAILED DESCRIPTION OF THE PREFERRED EMBODIMENT

Figure 3:
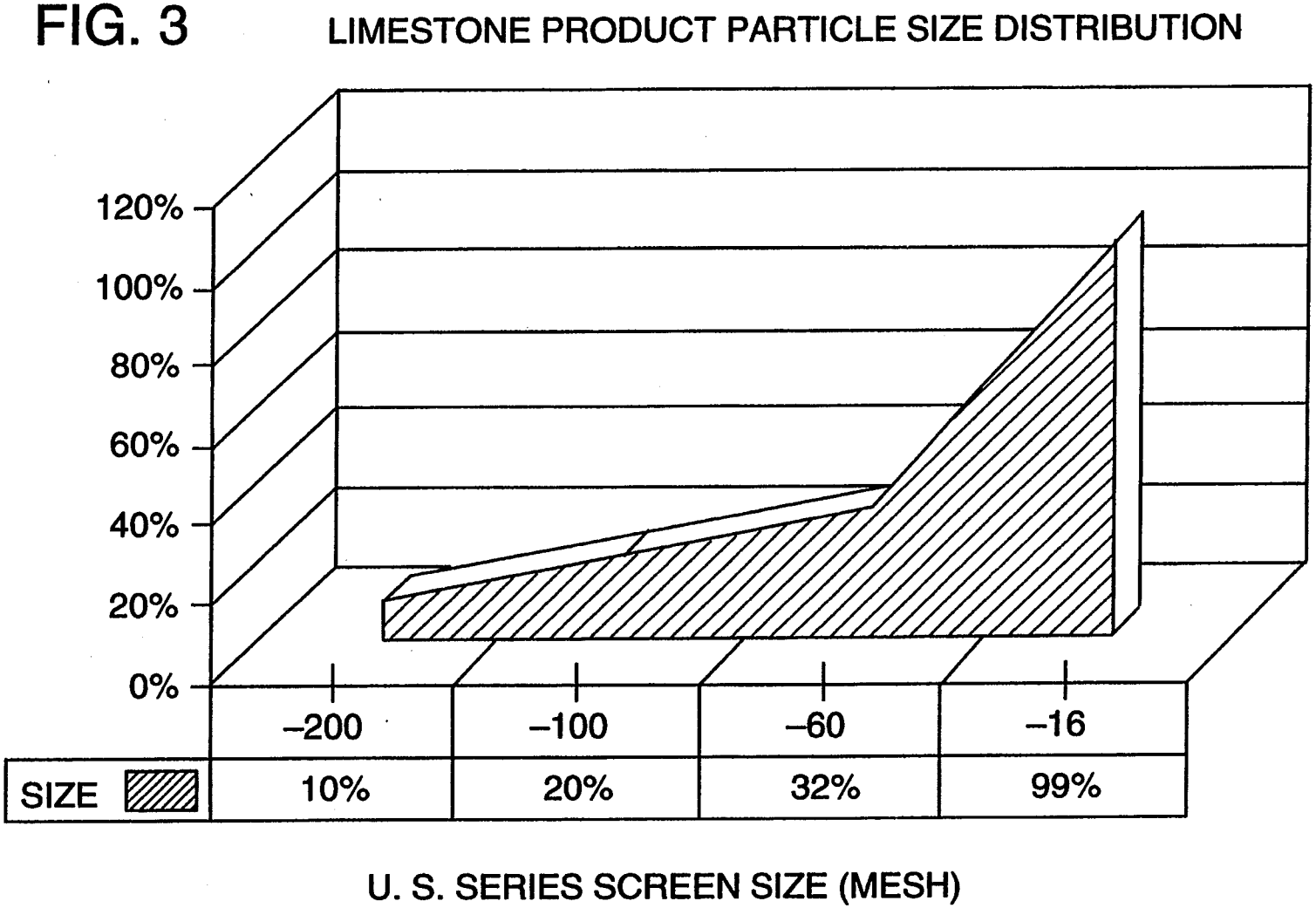
FIG. 3 is a chart which shows the percent of limestone product which is produced in the process of the present invention and which passes through standard U.S. Series screen (mesh) sizes.

There is shown, in FIG. 1, a simplified process flow diagram for the present process for grinding limestone. The process includes a limestone feedstock F, a hopper 10 or other holding bin, and a roll grinder 12. The limestone feedstock F and product P are transported by pneumatic or other means between process steps.

As best shown in detail in FIG. 2, the exemplary roll grinder 12 comprises a feed area 14, a feed roll 16, a first pair of grinding rolls 18, 20 and a second pair of grinding rolls 22, 24. The feed roll 16, the first pair 18, 20, of grinding rolls, and the second pair 22, 24, of grinding rolls are each driven by independent drive means (not shown) such as electric motors.

The feedstock F is fed from the feed area 14 to the feed roll 16 by gravity. A limit bar 26 extends across the opening of the feed area 14 to provide limiting means for the feedstock F entering the grinder 12. In a typical arrangement of the grinder 12, the feed roll 16 is a vaned or corrugated roll and is timed accordingly to operate in conjunction with the first pair of grinding rolls 18, 20.

The first pair of grinding rolls 18, 20 comprises opposing rotating rolls, namely a fast roll 18 and a slow roll 20, the directions of rotation of which are as shown by the arrows indicated at 28 in FIG. 2. The rolls 18, 20, rotate about substantially horizontal axes. The rolls 18, 20, are separated by a first nip or gap, indicated at 30, which is a predetermined distance between the rolls 18, 20. The first nip 30 is empirically determined, and is based upon the feedstock F particle size. Because limestone is a natural mineral, it is difficult to precisely predict the feedstock particle size, however, experience shows that particle sizes in the range of 0.125 inch to 0.75 inch are common. To accommodate such particle sizes, the nip 30 of the first pair of rolls 18, 20, is typically in the range of about 0.05 inch to about 0.3 inch.

The second pair of grinding rolls 22, 24, also comprise opposing rotating rolls, namely a fast roll 22 and a slow roll 24 the directions of rotation of which are as shown by the arrows indicated at 32 in FIG. 2. The rolls 22, 24, rotate about substantially horizontal axes. The rolls 22, 24, are separated by a second nip or gap, indicated at 34, which is based upon the final product P particle size distribution desired. A preferred particle size distribution includes particles in a range of about 75% to about 90% greater than 200 mesh. A most preferred particle size distribution is as shown in FIG. 3, wherein about 10% of the product is smaller than 200 mesh, about 10% is between 100 mesh and 200 mesh, about 12% is between 60 mesh and 100 mesh, about 67% is between 16 mesh and 60 mesh, and about 1% is larger than 16 mesh. In a preferred process, this particle size distribution is produced with the nip 34 between the second set of rolls 22, 24 in the range of about 0.01 inch to about 0.05 inch.

Each of the fast and slow rolls of the first pair 18, 20 and the second pair 22, 24 can rotate at different velocities relative to its opposing rotating mate to produce a shear in the particles as they pass into and through the nip area 36 and nip 30. The shear ratio, which is the measurement of shear, is the ratio of the velocity of the fast roll 18 to the velocity of the slow roll 20. Typically, the shear ratio of a pair of rolls such as the first pair 18, 20, in an operating grinder 12 will be between 1:1 and 2:1, preferably about 1.2:1. For example, in an operating grinder in which the fast roll rotates at 600 rpm and the slow roll rotates at 500 rpm, the shear ratio is 600:500 or 1.2:1.

The precise shear ratio is determined on an empirical basis for any given supply of limestone. Again, because limestone is a naturally occurring mineral, the properties thereof may be inconsistent between loads quarried at different sites. In particular, the friability or fragility of the crystalline limestone structure may vary between quarries and loads. Experience has shown, however, that Dolomite, which is a calcium magnesium carbonate type limestone prevalent in the six states in the Ohio River Valley, is best processed at a shear ratio of about 1.2:1. More friable types of limestone would be processed at lower shear ratios, such as between 1.2:1 and 1:1. Conversely, less friable types of limestone would be processed at higher shear ratios, such as between 2:1 and 1.2:1.

In a preferred process, the rotational velocity of the rolls is in the range of about 500 rpm to about 1000 rpm. The upper limit of rotational velocity is dependent more upon machine construction than on the grinding process. Nevertheless, the higher the velocities of rolls 18, 20, of the first pair, the more likely it is that the feedstock F will bounce or jump on the top of the rolls 18, 20, as it is fed into the grinder 12. Thus, velocity is a feed characteristic, and preferably, the first pair of rolls 18, 20 rotate at a lower velocities than the rolls 22, 24, of the second pair. The rolls 22, 24, of the second pair can typically rotate at higher velocities because the particles are substantially smaller when they reach the second pair of rolls 22, 24, and thus do not tend to bounce or jump thereon.

In carrying out the present process, the velocities of rolls 18, 20, of the first pair, relative to the velocities of rolls 22, 24, of the second pair are determined by balancing the amperage drawn by the drive motors for each pair of rolls. If the amperage is maintained so as to be about equal between the motors, the work performed by the first pair of rolls 18, 20, is thought to be about equal to the work performed by the second pair of rolls 22, 24.

In the preferred process, limestone feedstock F is transported from the hopper 10 to the grinder 12 by means such as pneumatic transport or the like. The limestone is fed into the feed area 14 just above the feed roll 16. The limit bar 26 extends across the exit of the feed area 14 and limits the feed of limestone from the feed roll 16 into the first pair of rolls 18, 20. A deflector plate 38, mounted above the rolls 18, 20, and adjacent to the feed roll 16, deflects limestone which feeds around the feed roll 16, and redirects the limestone into the nip area 36 of the first pair of rolls 18, 20. The velocity of the feed roll 16 is controlled to maintain the waterfall or curtain effect which is indicated at 40 in FIG. 2.

The limestone travels into the nip area 36, which is the area just above the nip 30 between the rolls 18, 20. Grinding of the limestone particles occurs in the nip area 36 and nip 30 within a dwell angle of about 15° to about 30° as indicated at $\alpha$ in FIG. 2. As the limestone travels therethrough, the compression and shear imparted by the rolls 18, 20, on the limestone causes the particles to work against each other thereby breaking down or fracturing the crystalline structure. By closely controlling the nip, and in particular the nip 34 of the last pair of rolls 22, 24, the particle size distribution of the product P is closely controlled. In a sense, the work done on the limestone particles increases as the nip decreases. Thus, the larger the nip, the less the work that is done on the limestone particles. Conversely, the smaller the nip, the greater the work that is done on the limestone particles.

The grinding operation is optimized by controlling the rate at which feedstock F exits the feed roll 16 to create a waterfall or curtain effect shown at 40. That is, the feedstock F which exits the feed roll 16 must be such as to permit a small accumulation of limestone on the first pair of rolls 18, 20 to effectuate grinding in the nip area 36, but not so much as to flood the rolls 18, 20, or to increase accumulation of limestone thereon. Again, optimum operation is achieved by maintaining the waterfall effect 40 throughout the grinder 12.

As the limestone passes through the first pair of rolls 18, 20, a portion of the limestone may not pass directly down to the nip area 42 of the second pair of rolls 22, 24. Instead, some of the limestone may remain on the rolls 18, 20, and some may be directed out of the pathway formed by the curtain effect 40. Roll scrapers 44 or brushes (one shown), which are mounted below and adjacent to rolls 18, 20, contact the rolls 18, 20, and remove any limestone which may remain thereon. Deflector plates 46 (one shown) which are also mounted below and adjacent to rolls 18, 20, redirect the limestone back into the pathway formed by the curtain effect 40.

Similarly, roll scrapers 48 or brushes (one shown) are mounted below and adjacent to the second pair of rolls 22, 24, to remove any limestone which may remain thereon subsequent to the final grinding step.

Optionally, the process of the present invention can be performed in a multi-pass mode or arrangement, that is, the limestone can be fed back into the grinder to affect the desired particle size distribution. In a preferred process, the limestone is discharged from the grinder in a first pass and fed into a separator 50 such as a sifter which is shown in dashed lines in FIG. 1.

The exemplary separator 50 separates the limestone particles which are of a larger size than desired from the product P stream. In the multi-pass arrangement, such larger than desired particles, which are removed from the product stream, are fed back into the feed stream at a location before the grinder in a refeed stream shown as R in FIG.1. Alternatively, the larger particles can be fed back into the hopper 10. Separating processes are commonly known in the art and include methods such as sifting, screening, and the like.

The separating step provides additional flexibility to the present process by permitting the grinding process to be operated with somewhat larger nips between the rollers. The result is that through the first pass, the percentage of fines (i.e., particles less than 200 mesh) is reduced; however, the percentage of large particles (i.e., particles greater than 14 to 16 mesh) is increased. With the separating step included in the process, the large particles are separated from the grinder discharge stream and are fed back to the grinder, while the particles which are within the desired particle size distribution pass through the separator and continue on to the product stream. In this manner of operation, the particles which are within the desired product size distribution are not overworked, and the particles which are greater than the desired product size distribution are refed back into the process to be reworked.

The exemplified process is carried out in a grinder 12 as shown and described having a feed roll 16, a first pair of grinding rolls 18, 20, and second pair of rolls 22, 24. It should be understood that this process is exemplary, and that this process may be carried out in a grinder having more or less pairs of grinding rolls than that shown and described.

From the foregoing it will be observed that numerous modifications can be effected without departing from the true spirit and scope of the novel concepts of the present invention. It will be understood that no limitation with respect to the specific embodiment illustrated herein is intended or should be inferred. It is, of course, intended to cover by the appended claims all such modifications as fall within the scope of the claims.

What is claimed is:

1. A process for grinding limestone to a predetermined particle size distribution comprising the steps of:

a. providing a limestone feedstock;

b. feeding the limestone feedstock in at least one pass into a roll grinder, the roll grinder having a first pair of opposing rotating rolls having smooth surfaces, said rolls being separated by a predetermined nip therebetween, said rolls having predetermined circumferential velocity; and c. grinding the limestone feedstock to a particle size distribution which is about 90% by weight greater than 200 mesh, about 80% by weight greater than 100 mesh, about 68% by weight greater than 60 mesh, and about 1% by weight greater than 16 mesh to produce a limestone product.

2. The process of claim 1 wherein the first pair of rolls is separated by a nip therebetween of about 0.05 inch to about 0.3 inch.

3. The process of claim 1 further including the steps of separating the limestone product to remove particles greater than about 16 mesh and refeeding the removed particles into the grinder.

4. A process for grinding limestone to a predetermined particle size distribution comprising the steps of:

a. providing a limestone feedstock;

b. feeding the limestone feedstock in at least one pass into a roll grinder, the roll grinder having a first pair of opposing rotating rolls having smooth surfaces, said rolls being separated by a predetermined nip therebetween, said rolls having a predetermined circumferential velocity;

c. passing the limestone through a second pair of opposing rolls having smooth surfaces, said second pair of rolls being separated by a second predetermined nip therebetween, said second nip being less than the nip separating the first pair of rolls, said second pair of rolls having a predetermined circumferential velocity; and d. grinding the limestone feedstock to a particle size distribution which is about 90% by weight greater than 200 mesh, about 80% by weight greater than 100 mesh, about 68% by weight greater than 60 mesh, and about 1% by weight greater than 16 mesh to produce a limestone product.

5. The process of claim 4 wherein at least one of said first and second pair of rolls rotate at a differential velocity, said differential velocity being in the range of about 1:1 to about 2:1.

6. The process of claim 4 wherein the second pair of rolls is separated by a nip therebetween of about 0.01 inch to about 0.05 inch.

* * * * *